US006765157B2

(12) United States Patent
Rademacher et al.

(10) Patent No.: US 6,765,157 B2
(45) **Date of Patent: *Jul. 20, 2004**

(54) TRANSFER SWITCH WITH IMPROVED ACTUATOR

(75) Inventors: Loren L. Rademacher, Andover, MN (US); Larry D. Hokenson, Isanti, MN (US); Thomas C. Simon, Maple Grove, MN (US); John E. Morley, Stacy, MN (US); Larry H. Smith, Coon Rapids, MN (US); Michael A. Peterson, Brooklyn Park, MN (US); Peter M. Hawkins, Mounds View, MN (US); Constantine Xykis, Eagan, MN (US)

(73) Assignee: Onan Corporation, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/202,260

(22) Filed: Jul. 24, 2002

(65) Prior Publication Data

US 2004/0016627 A1 Jan. 29, 2004

(51) Int. Cl.[7] ..... H01H 9/00
(52) U.S. Cl. ..... 200/1 R; 200/1 V
(58) Field of Search ..... 200/1 V, 1 R, 200/50.32, 50.33, 573, 574, 401, 416, 428, 461, 33 R, 34, 46, 45 G; 218/154

(56) References Cited

U.S. PATENT DOCUMENTS

| | | | | |
|---|---|---|---|---|
| 4,021,678 A | 5/1977 | Moakler et al. | ..... | 307/64 |
| 4,168,407 A | 9/1979 | Wiktor | ..... | 200/18 |
| 4,405,867 A | 9/1983 | Moakler et al. | ..... | 307/64 |
| 4,423,336 A | 12/1983 | Iverson et al. | ..... | 307/64 |
| 5,070,252 A | 12/1991 | Castenschiold et al. | ..... | 307/64 |
| 5,081,367 A | 1/1992 | Smith et al. | ..... | 307/64 |
| 5,200,586 A | 4/1993 | Smith et al. | ..... | 200/50 |
| 5,581,133 A | 12/1996 | Smith et al. | ..... | 307/64 |

*Primary Examiner*—Elvin Enad
*Assistant Examiner*—Lisa Klaus
(74) *Attorney, Agent, or Firm*—Schwegman, Lundberg, Woessner & Kluth, P.A.

(57) ABSTRACT

A transfer switch that includes output contacts, primary input contacts, secondary input contacts and a toggle mechanism. The toggle mechanism includes moving contacts that alternately connect the output contacts with the primary and secondary input contacts. The transfer switch includes an actuator that rotates the first crossbar to alternately engage a first set of moving contacts with the output contacts and the primary input contacts, and rotates the second crossbar to alternately engage a second set of moving contacts with the output contacts and the secondary input contacts. A method of actuating a transfer switch to alternate the supply of power to an electric load. The method includes rotating a first crossbar within the transfer switch to engage a first set of switching contacts with a primary power source and rotating a second crossbar within the transfer switch to engage a second set of switching contacts with a secondary power source.

29 Claims, 9 Drawing Sheets

TRANSFER SWITCH WITH IMPROVED ACTUATOR

FIELD OF THE INVENTION

The present invention relates to a transfer switch, and in particular to a transfer switch that includes an improved actuator.

BACKGROUND

A transfer switch is used to switch an electric load back and forth between a primary source, such as a utility, and a secondary source, such as a generator. Transferring power from the primary source to the secondary source is necessary when the utility experiences a blackout. The transfer switch is also used to switch the power source back to utility power when the power outage is over.

A typical transfer switch is composed of an actuator and a toggle mechanism. The actuator operates by supplying energy to the toggle mechanism to maneuver movable contacts that are within the toggle mechanism relative to stationary power input contacts. The movable contacts engage one set of stationary contacts when power is supplied from the primary source and engage another set of stationary contacts when power is supplied from the secondary source.

Actuators are activated either manually or automatically at a desired time to supply energy to the movable contacts on the toggle mechanism. Many transfer switches are able to disconnect the load from both sources for a desired period of time in order to allow residual electricity to discharge before the load is switched to an alternate power source.

FIGS. 1–4 illustrate an improved electric transfer switch 10. Transfer switch 10 includes a toggle mechanism 12 (FIG. 2). The toggle mechanism 12 includes a pair of crossbars 14, 15 (FIGS. 3 and 4) that extend through the transfer switch 10. The crossbars 14, 15 in the toggle mechanism 12 are connected to an actuator 16 of the present invention that rotates the crossbars 14, 15 about their respective longitudinal axes.

A first set of moveable contacts 20 is carried by crossbar 14 and a second set of movable contacts 25 is carried by crossbar 15. Each moveable contact 20, 25 is connected to an output contact 21 and is adapted to be intermittently connected to a respective primary input contact 22 or a secondary input contact 23 depending on which crossbar 14, 15 the movable contacts 20, 25 are mounted on. Cams 29 are mounted on the crossbars 14, 15 to maneuver the movable contacts 20, 25 into, and out of, engagement with the stationary input contacts 22, 23.

FIG. 3 shows the movable contacts 20 engaged with the primary input contacts 22 when power is being supplied from a primary power source, such as a utility. As shown in FIG. 4, when there is an interruption in the primary power supply, the cams 29 on crossbar 14 rotate to disengage the movable contacts 20 from the primary input contacts 22, and the cams 29 on crossbar 15 rotate to allow the movable contacts 25 to engage secondary input contacts 23 so that power can be supplied from a secondary power source, such as a generator.

A similar operation is performed to transfer back to the primary source from the secondary source. The cams 29 on crossbar 15 rotate to disengage the movable contacts 25 from the secondary input contacts 23 and the cams 29 on crossbar 14 rotate to allow the movable contacts 20 to engage the primary input contacts 22 so that power can once again be supplied from the primary source.

Springs 28 are disposed between each of the moveable contacts 20, 25 and another portion of the transfer switch 10. The springs 28 apply a force to each movable contact 20, 25 that directs each moveable contact 20 against a corresponding stationary input contact 22, 23.

During the operation of a typical transfer switch there may be extreme conditions where the movable contacts can become slightly tack welded to the stationary contacts. Known actuators are often unable to apply a large enough force to the contact-carrying members within the transfer switch to permit the contacts to open in a desired amount of time. In addition, existing actuators often times do not allow for different programmed transitions of the movable contacts within the transfer switch between the stationary input contacts of the alternative power sources. One example of a programmed transition could be where one set of moving contacts is disengaged from the primary input contacts followed by a predetermined delay before the another set of movable contacts is engaged with the secondary input contacts.

There is a need for actuator 16 which can be used with transfer switches that include two rotating crossbars. Actuator 16 is able to independently operate the two crossbars and generate enough operating force to separate any tack-welded contacts that need to be maneuvered by the crossbars. Actuator 16 is also be able to provide for a variety of programmed transitions between two separate power sources.

SUMMARY OF THE INVENTION

The present invention relates to a transfer switch that includes an actuator which is capable of independently operating two rotating crossbars within the transfer switch. Since the crossbars in the transfer switch are operated independently, the actuator may include two similar but interrelated mechanisms such that one mechanism maneuvers one crossbar and the other mechanism maneuvers the other crossbar.

Using two mechanisms within a single actuator facilitates operating the actuator with a variety of programmed transitions between two separate power sources. One such transition could involve including a predetermined delay before switching power sources. Another programmed transition could be a closed transition where both sets of movable contacts within the transfer switch are simultaneously engaged with the primary and secondary input contacts before one set of movable contacts is disengaged. The closed transition provides a no break transfer of power from one source to another. No break power transfers are likely to increase the service life of the contacts within the transfer switch, as well as providing the primary function of supplying loads that can not tolerate any kind of interruption, however brief.

In addition, it is easier to design each of the mechanisms so that they generate a larger operating force on the crossbars than could be generated by a single mechanism. The larger operating force on each crossbar helps separate the movable contacts when the contacts have become tack-welded together.

The transfer switch includes output contacts, primary input contacts, secondary input contacts and a toggle mechanism. The toggle mechanism includes moving contacts that alternately connect the output contacts with the primary and secondary input contacts. The transfer switch further includes an actuator that rotates the first crossbar to alternately engage a first set of moving contacts with the output contacts and the primary input contacts, and rotates the second crossbar to alternately engage a second set of moving contacts with the output contacts and the secondary input contacts.

The present invention also relates to a method of actuating a transfer switch to alternate the supply of power to an electric load. The method includes rotating a first crossbar within the transfer switch to engage a first set of switching contacts with a primary power source. The method further includes rotating a second crossbar within the transfer switch to engage a second set of switching contacts with a secondary power source.

The present invention also relates to a transfer switch that includes output contacts, primary input contacts, secondary input contacts and a toggle mechanism which has a first crossbar and a second crossbar. The transfer switch further includes means for rotating the first crossbar to engage a first set of switching contacts with a primary power source and rotating the second crossbar to engage a second set of switching contacts with a secondary power source.

In another aspect, the present invention is directed to an actuator for a transfer switch. The actuator includes a pair of couplings that are each adapted to be connected to a separate crossbar in the transfer switch, and a pair of indexing mechanisms that are each engaged with a separate one of the couplings to apply torque to the couplings. The actuator further includes a pair of crankshafts that are each engaged with a separate one of the indexing mechanisms to apply torque to the indexing mechanisms, and a pair of stored energy devices that are each engaged with a separate one of crankshafts to apply torque to the crankshafts using energy released by the stored energy devices.

DETAILED DESCRIPTION

Figure 1:
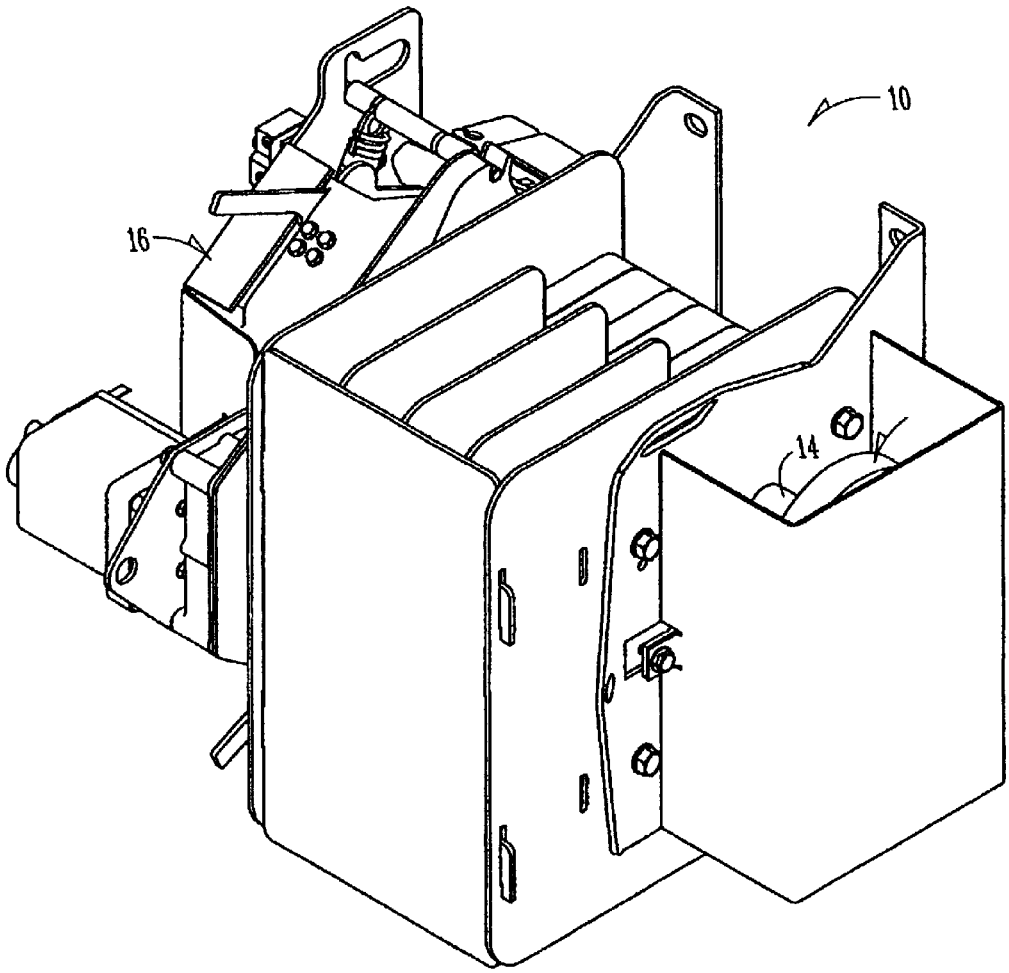
FIG. 1 is a perspective view illustrating a transfer switch of the present invention.
Figure 2:
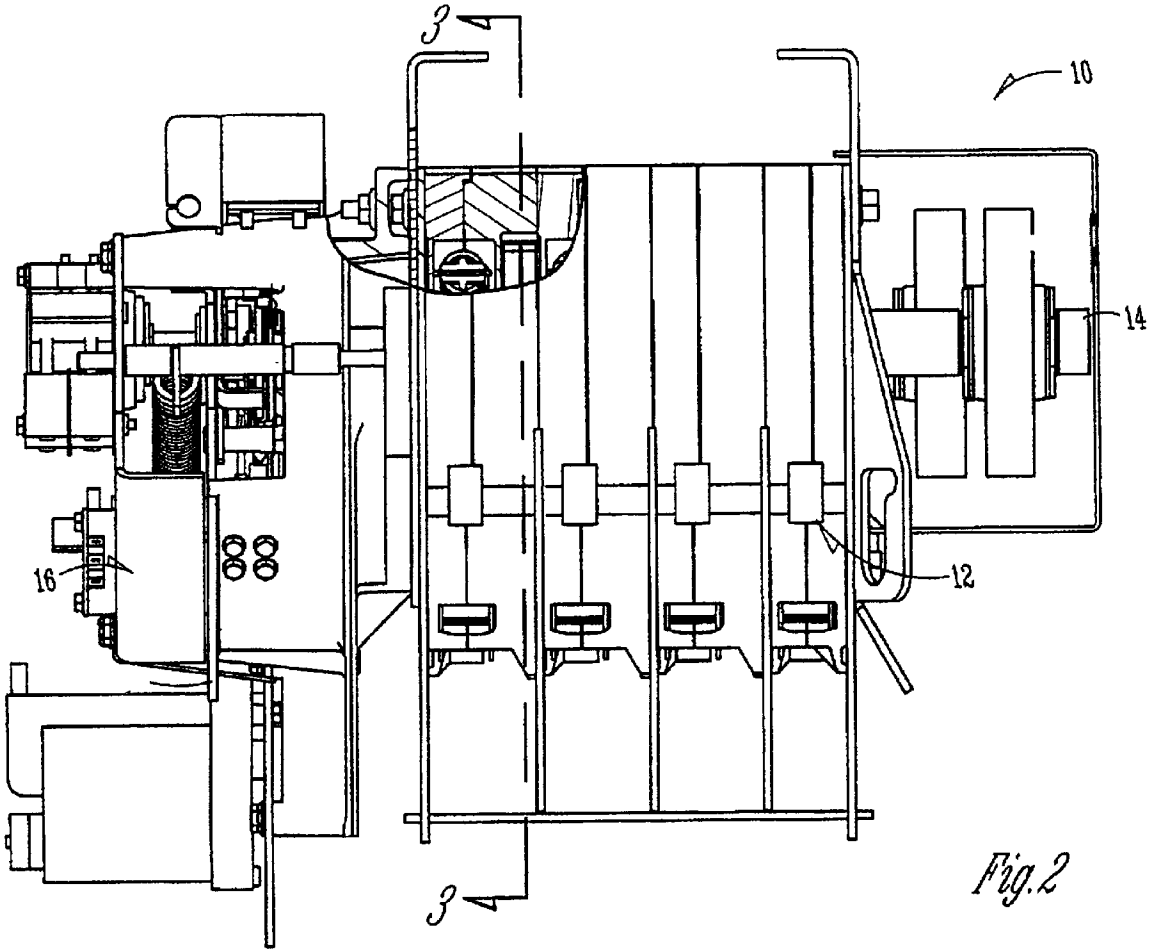
FIG. 2 is a top view of the transfer switch shown in FIG. 1.

In the following detailed description, reference is made to the accompanying drawings which show by way of illustration specific embodiments in which the invention may be practiced. These embodiments are described in sufficient detail to enable those skilled in the art to practice the invention, and it is to be understood that other embodiments may be utilized and structural changes made without departing from the scope of the present invention. Therefore, the following detailed description is not to be taken in a limiting sense, and the scope of the present invention is defined by the appended claims and their equivalents.

As stated previously, FIGS. 1–4 show an example embodiment of an electric transfer switch 10 that includes an improved actuator 16. Toggle mechanism 12 is connected to actuator 16 such that actuator 16 rotates first crossbar 14 to alternately engage a first set of moving contacts 20 with output contacts 21 and primary input contacts 22. Actuator 16 also rotates second crossbar 15 to alternately engage a second set of moving contacts 25 with output contacts 21 and secondary input contacts 23.

Figure 3:
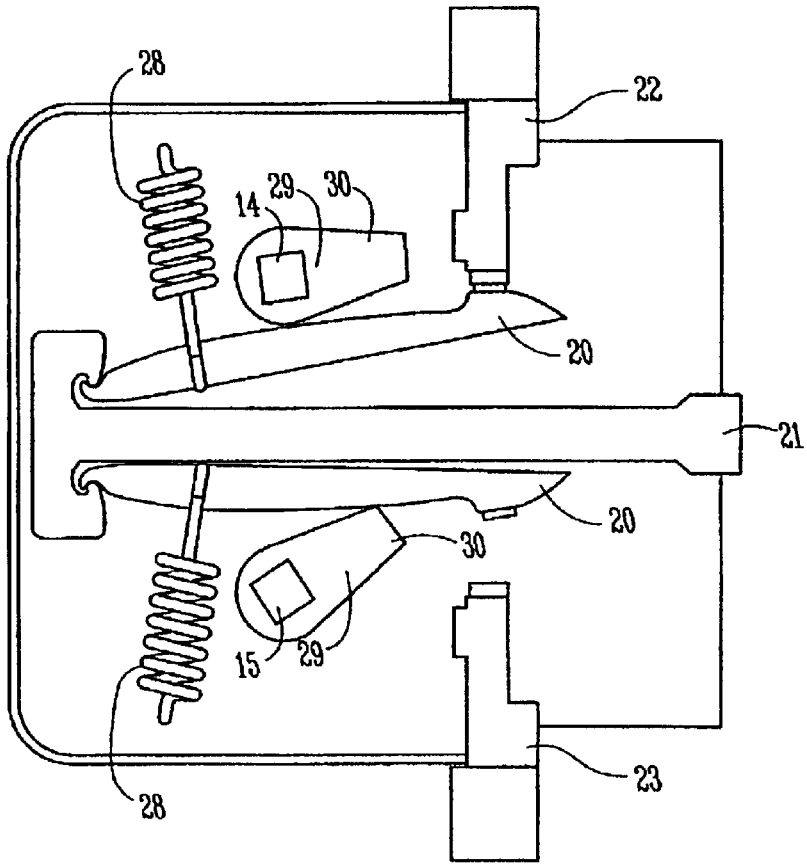
FIG. 3 is a schematic cross-sectional view of the transfer switch shown in FIG. 2 taken along line 3—3 with the transfer switch in position to supply power from a primary power source.
Figure 4:
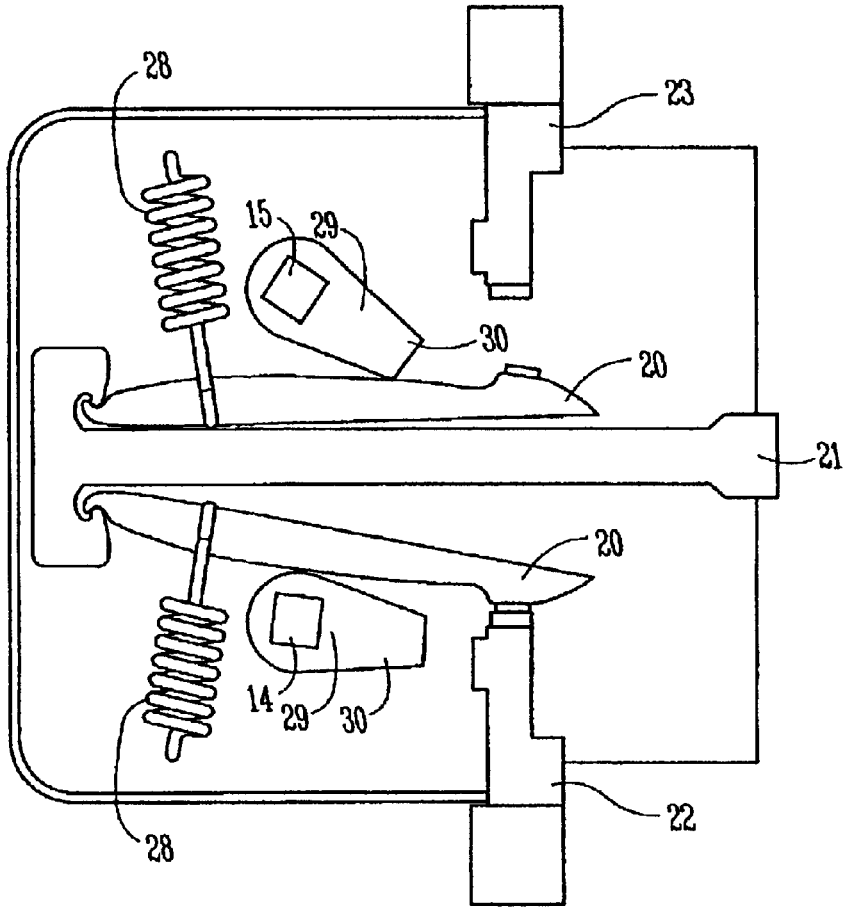
FIG. 4 is a schematic cross-sectional view similar to FIG. 3 with the transfer switch in position to supply power from a secondary power source.

FIG. 3 shows the movable contacts 20 engaged with the primary input contacts 22 when power is being from a primary power source, such as a utility. As shown in FIG. 4, when there is an interruption in the primary power supply, actuator 16 rotates crossbar 14 to disengage the first set of movable contacts 20 from the primary input contacts 22. Actuator 16 also rotates crossbar 15 rotate to engage the second set of movable contacts 25 with secondary input contacts 23 so that power can be supplied from a secondary power source, such as a generator.

A similar operation is performed to transfer back to the primary source from the secondary source. Actuator 16 rotates second crossbar 15 to disengage the second set of movable contacts 25 from secondary input contacts 23 and rotates first crossbar 14 to engage the first set of movable contacts 20 with the primary input contacts 22 so that power can once again be supplied from the primary source. In some embodiments, first crossbar 14 is parallel to second crossbar 15 and actuator 16 rotates first crossbar 14 in one direction and rotates second crossbar 15 in an opposing direction.

Figure 5:
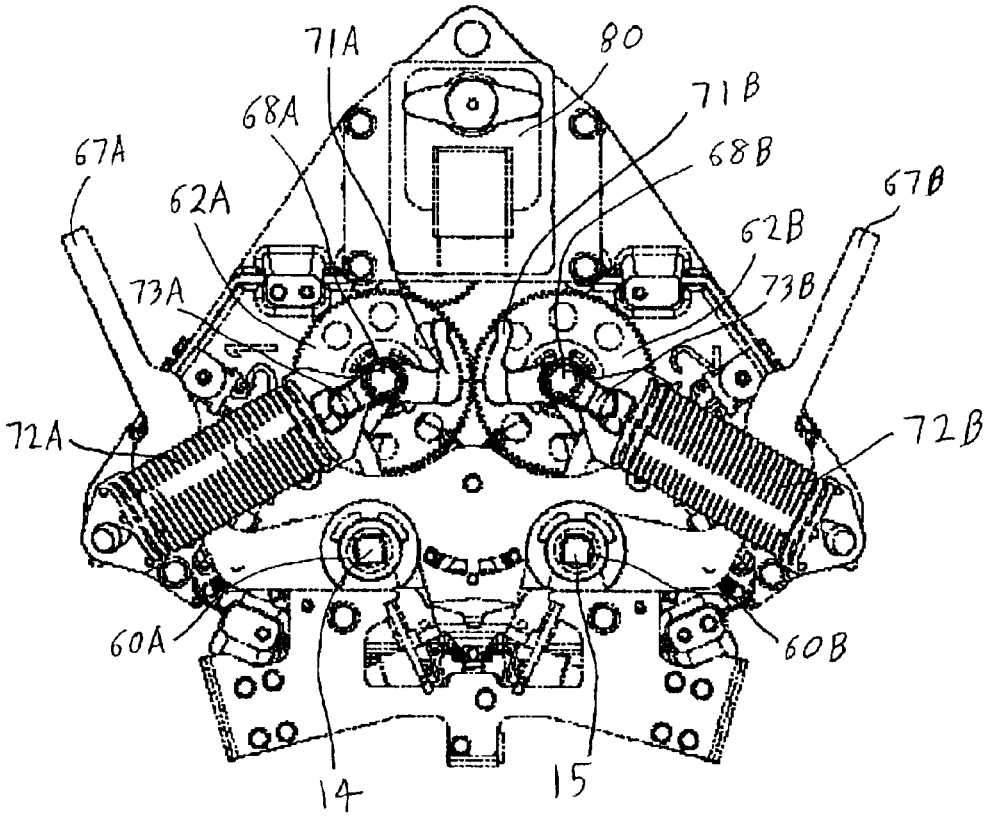
FIG. 5 is a side view illustrating the actuator in the transfer switch shown in FIG. 1 with portions of the actuator removed for purposes of clarity.
Figure 6:
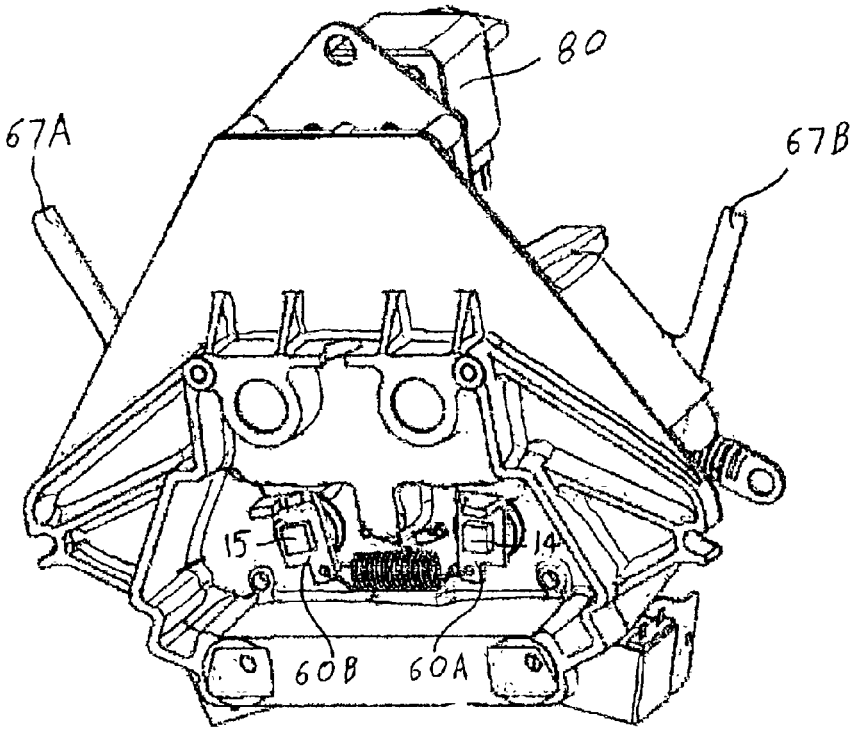
FIG. 6 is a perspective view illustrating an opposing side of the actuator shown in FIG. 5 with portions of the actuator removed for purposes of clarity.
Figure 7:
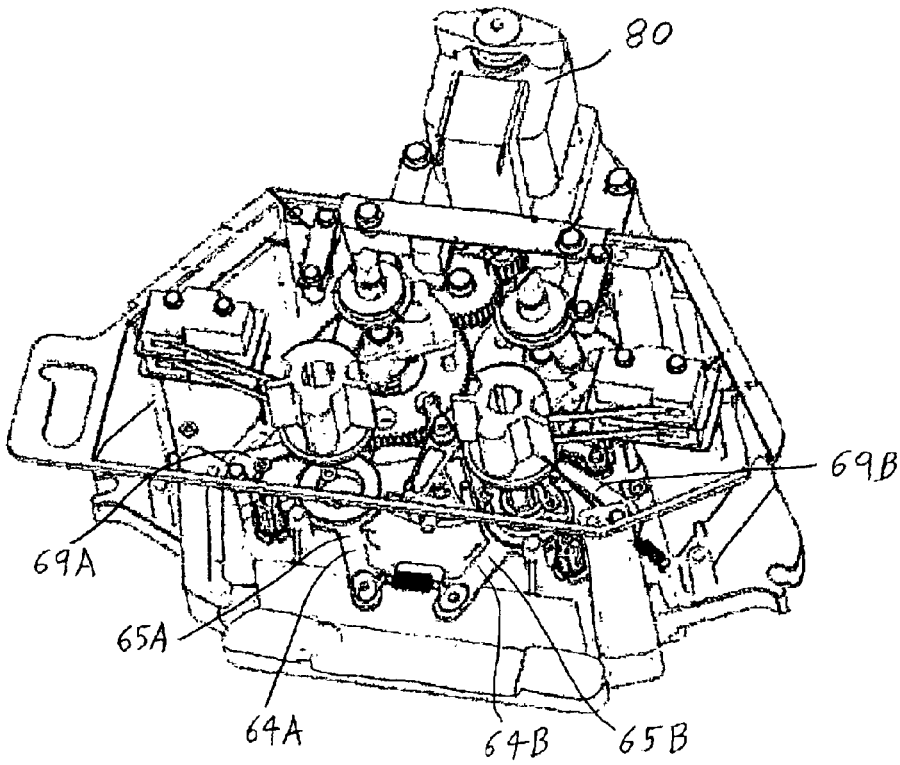
FIG. 7 is a perspective view illustrating an opposing side of the actuator shown in FIG. 6 with portions of the actuator removed for purposes of clarity.
Figure 8:
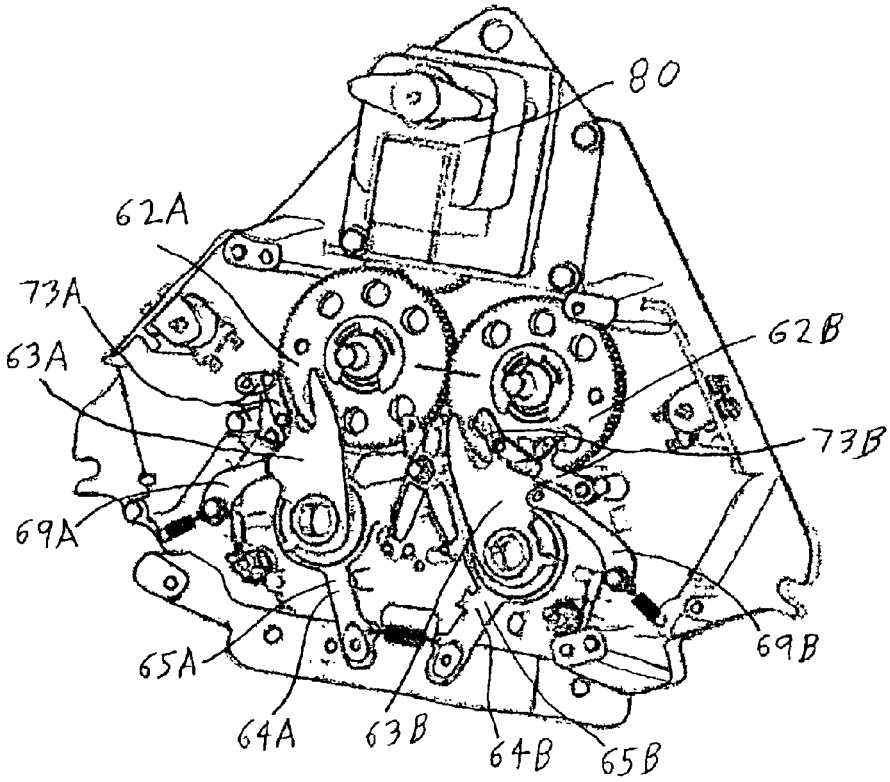
FIG. 8 is a perspective view similar to FIG. 7 with additional portions of the actuator removed for purposes of clarity.
Figure 9:
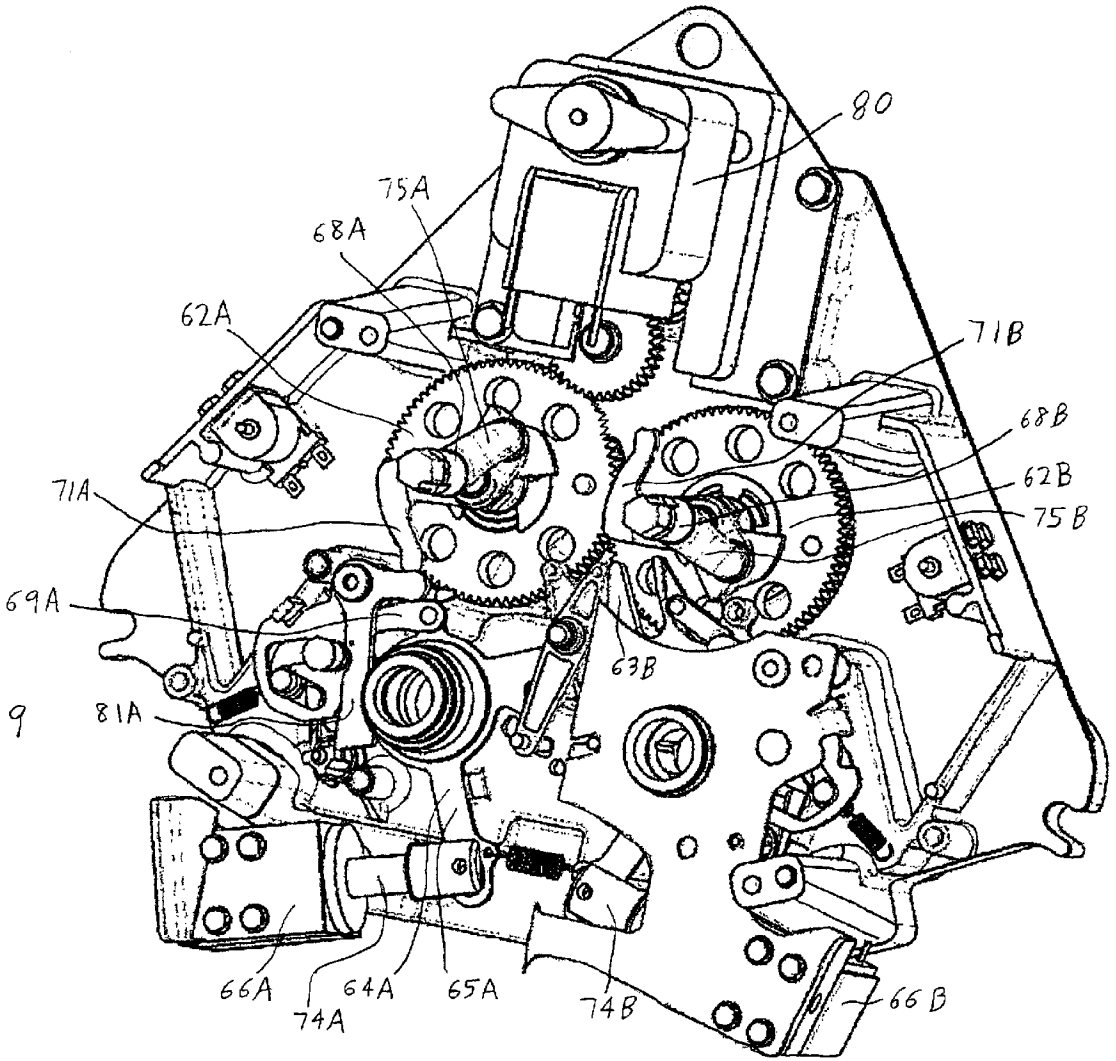
FIG. 9 is a perspective view similar to FIG. 8 with some portions of the actuator added for descriptive purposes.

As shown in FIGS. 5–9, actuator 16 may include a pair of couplings 60A, 60B such that one coupling 60A applies torque to first crossbar 14 and the other coupling 60B applies torque to second crossbar 15 (FIGS. 5 and 6). In some embodiments, actuator 16 includes a pair of indexing mechanisms 62A, 62B such that one indexing mechanism 62A applies torque to one coupling 60A and the other indexing mechanism 62B applies torque to the other coupling 60B. Each indexing mechanism 62A, 62B may include a respective fork 63A, 63B such that one fork 63A engages one coupling 60A and the other fork 63B engages the other coupling 60B (FIGS. 5, 8 and 9).

The couplings 60A, 60B and indexing mechanisms 62A, 62B can have any suitable configuration as long as torque is transferred to the respective crossbars 14, 15 through the couplings 60A, 60B and indexing mechanisms 62A, 62B. In addition, in some embodiments indexing mechanisms 62A, 62B may include some device other than forks 63A, 63B to transfer torque to couplings 60A, 60B.

Actuator 16 may further include a pair of locks 64A, 64B. One lock 64A secures one indexing mechanism 62A and the other lock 64B secures the other indexing mechanism 62B when the first and second sets of moving contacts 20, 25 on the first and second crossbars 14, 15 are disengaged from the respective primary and secondary input contacts 22, 23. Locks 64A, 64B prevent crossbars 14, 15 from moving so that respective moving contacts 20, 25 can not engage primary and secondary input contacts 22, 23 unless the corresponding lock 64A, 64B is released.

Although locks 64A, 64B can have any suitable configuration, in the illustrated sample embodiment, locks 64A, 64B include in part, pivot arms 65A, 65B (FIGS. 7–9), transfer bars 69A, 69B and linkages 73A, 73B (FIG. 8). Actuator 16 may further include a pair of solenoids 66A, 66B (FIG. 9) such that one solenoid 66A releases one lock 64A and the other solenoid 66B releases the other lock 64B to allow the respective indexing mechanisms 62A, 62B to move. Solenoids 66A, 66B may be used in combination with a controller to permit locks 64A, 64B to operate automatically.

A partial description of the operation of one of the locks 64A is summarized hereafter. Plunger 74A on solenoid 66A is retracted such that plunger 74A rotates pivot arm 65A. Pivot arm 65A engages transfer bar 69A, which, in turn, manipulates linkage 73A permitting fork 63A to rotate and thereby allow crossbar 14 to rotate.

In some embodiments, actuator 16 includes a pair of handles 67A, 67B (FIGS. 5 and 6). One handle 67A releases one lock 64A and the other handle 67B releases the other lock 64B to allow the indexing mechanisms 62A, 62B to move.

Actuator 16 includes a pair of crankshafts 68A, 68B such that one crankshaft 68A engages one indexing mechanism 62A and the other crankshaft 68A engages the other indexing mechanism 62B. Each crankshaft 68A, 68B includes a respective first throw 71A, 71B such that one first throw 71A engages one fork 63A and the other first throw 71B engages the other fork 63B (FIGS. 5 and 9).

Actuator 16 may further include a pair of stored energy devices, such as springs 72A, 72B (FIG. 5), that engage a respective second throw 75A, 75B on each of the crankshafts 68A, 68B. One spring 72A engages one second throw 75A and the other spring 72B engages the other second throw 75B.

In an example embodiment, actuator 16 includes a motor 80 that is coupled to each of the crankshafts 68A, 68B through one or more force-transmitting devices, such as gears. Motor 80 adds energy to a respective one of the springs 72A, 72B as soon as the corresponding first or second set of moving contacts 20, 25 on the first and second crossbars 14, 15 is disengaged from the respective primary or secondary input contacts 22, 23. The stored energy in springs 72A, 72B is eventually released to move crossbars 14, 15 and re-engage the first and/or secondary moving contacts 20, 25 with the respective primary and secondary input contacts 22, 23.

Actuator 16 may further include a pair of crank locks 81A, 81B. One crank lock 81A secures one crankshaft 68A and the other crank lock 81B secures the other crankshaft 68A. The respective crank locks 81A, 81B secure the corresponding crankshafts 68A, 68B after motor 80 stores sufficient energy in a corresponding one of the springs 72A, 72B. In some embodiments, handles 67A, 67B also release respective crank locks 81A, 81B to allow the respective crankshafts 68A, 68B to move.

The present invention also relates a method of actuating a transfer switch 10 to alternate the supply of power to an electric load. The method includes rotating a first crossbar 14 within the transfer switch 10 to engage a first set of switching contacts 20 with a primary power source and rotating a second crossbar 15 within the transfer switch 14 to engage a second set of switching contacts 23 with a secondary power source.

Rotating first crossbar 14 within transfer switch 10 may include applying torque to first crossbar 14 using energy delivered by first spring 72A. In addition, rotating second crossbar 15 within transfer switch 10 may include applying torque to second crossbar 15 using energy delivered by second spring 72B. In some embodiments, first crossbar 14 and second crossbar 15 are parallel such that rotating first crossbar 14 includes rotating first crossbar 14 in one direction and rotating second crossbar 15 includes rotating second crossbar 15 in an opposing direction.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A transfer switch comprising:

output contacts;

primary input contacts;

secondary input contacts;

a toggle mechanism including a first crossbar and a second crossbar; and an actuator that rotates the first crossbar to alternately engage a first set of moving contacts with the output contacts and the primary input contacts, and rotates the second crossbar to alternately engage a second set of moving contacts with the output contacts and the secondary input contacts.

2. The transfer switch of claim 1 wherein the first crossbar is parallel to the second crossbar.

3. The transfer switch of claim 2 wherein the actuator rotates the first crossbar in one direction and rotates the second crossbar in an opposing direction.

4. The transfer switch of claim 1 wherein the actuator includes a pair of couplings such that one coupling applies torque to the first crossbar and the other coupling applies torque to the second crossbar.

5. The transfer switch of claim 4 wherein the actuator includes a pair of indexing mechanisms such that one indexing mechanism applies torque to the one coupling and the other indexing mechanism applies torque to the other coupling.

6. The transfer switch of claim 5 wherein the actuator includes a pair of locks such that the one lock secures one indexing mechanism and the other lock secures the other indexing mechanism when the moving contacts on the first and second crossbars are disengaged from the primary and secondary input contacts.

7. The transfer switch of claim 6 wherein the actuator includes a pair of solenoids such that one solenoid releases the one lock and the other solenoid releases the other lock to allow the indexing mechanisms to move.

8. The transfer switch of claim 6 wherein the actuator includes a pair of handles such that one handle releases the one lock and the other handle releases the other lock to allow the indexing mechanisms to move.

9. The transfer switch of claim 5 wherein each indexing mechanism includes a fork such that one fork engages the one coupling and the other fork engages the other coupling.

10. The transfer switch of claim 5 wherein the actuator includes a pair of crankshafts such that one crankshaft engages the one indexing mechanism and the other crankshaft engages the other indexing mechanism.

11. The transfer switch of claim 10 wherein each of the crankshafts includes a first throw and each indexing mechanism includes a fork such that one fork engages one first throw and the other fork engages the other first throw.

12. The transfer switch of claim 11 wherein the actuator includes a pair of stored energy devices and each of the crankshafts includes a second throw such that one stored energy device engages one second throw and the other stored energy devices engage the other second throw.

13. The transfer switch of claim 12 wherein each of the stored energy devices is a spring.

14. The transfer switch of claim 13 wherein the actuator includes a motor that is coupled to each of the crankshafts.

15. The transfer switch of claim 14 wherein the motor adds energy to the stored energy devices when the moving contacts on the first and second crossbars are engaged with the primary and secondary input contacts.

16. The transfer switch of claim 10 wherein the actuator includes a pair of crank locks such that one crank lock secures the one crankshaft and the other crank lock secures the other crankshaft.

17. The transfer switch of claim 16 wherein the actuator includes a pair of handles such that one handle releases the one crank lock and the other handle releases the other crank lock to allow the crankshafts to move.

18. A method of actuating a transfer switch to alternate the supply of power to an electric load comprising:

rotating a first crossbar within the transfer switch to engage a first set of switching contacts with a primary power source; and rotating a second crossbar within the transfer switch to engage a second set of switching contacts with a secondary power source.

19. The method of claim 18 wherein rotating the first crossbar within a transfer switch includes applying torque to the first crossbar using energy delivered by a first spring, and rotating the second crossbar within a transfer switch includes applying torque to the second crossbar using energy delivered by a second spring.

20. The method of claim 18 wherein the first crossbar and the second crossbar are parallel such that rotating the first crossbar within the transfer switch includes rotating the first crossbar in one direction and rotating the second crossbar within the transfer switch includes rotating the second crossbar in an opposing direction.

21. A transfer switch comprising:

output contacts;

primary input contacts;

secondary input contacts;

a toggle mechanism including a first crossbar and a second crossbar; and means for rotating the first crossbar to engage a first set of switching contacts with a primary power source and rotating the second crossbar to engage a second set of switching contacts with a secondary power source.

22. An actuator for a transfer switch comprising:

a pair of couplings that are each connected to a separate crossbar in the transfer switch;

a pair of indexing mechanisms that are each engaged with a separate one of the couplings to apply torque to the couplings;

a pair of crankshafts that are each engaged with a separate one of the indexing mechanisms to apply torque to the indexing mechanisms; and a pair of stored energy devices that are each engaged with a separate one of crankshafts to apply torque to the crankshafts using energy released by the stored energy devices.

23. The actuator of claim 22 further comprising a pair of locks such that one lock secures one indexing mechanism and the other lock secures the other indexing mechanism.

24. The actuator of claim 23 further comprising a pair of solenoids such that one solenoid releases the one lock and the other solenoid releases the other lock to allow the indexing mechanisms to move.

25. The actuator of claim 22 wherein each crankshaft includes a first throw and each indexing mechanism includes a fork such that one fork engages one first throw and the other fork engages the other first throw.

26. The actuator of claim 25 wherein each crankshaft includes a second throw such that one stored energy device engages one second throw and the other stored energy device engages the other second throw.

27. The actuator of claim 26 wherein each stored energy device is a spring.

28. The actuator of claim 22 wherein the actuator includes a motor that is coupled to each crankshaft to add energy to the stored energy devices.

29. The actuator of claim 22 wherein the actuator includes a pair of crank locks such that one crank lock secures one crankshaft and the other crank lock secures the other crankshaft.

* * * * *